US012733748B1

(12) United States Patent
Li

(10) Patent No.: US 12,733,748 B1
(45) Date of Patent: Sep. 15, 2026

(54) BED SHEET FASTENER

(71) Applicant: Meiyin Li, Meizhou (CN)

(72) Inventor: Meiyin Li, Meizhou (CN)

( * ) Notice: Subject to any disclaimer, the term of this patent is extended or adjusted under 35 U.S.C. 154(b) by 0 days.

(21) Appl. No.: 19/642,686

(22) Filed: Apr. 9, 2026

(51) Int. Cl.
*A47C 21/02* (2006.01)

(52) U.S. Cl.
CPC ..... *A47C 21/022* (2013.01)

(58) Field of Classification Search
None
See application file for complete search history.

(56) References Cited

U.S. PATENT DOCUMENTS 5,218,729 A * 6/1993 Walton ..... A47C 21/026 5/658

FOREIGN PATENT DOCUMENTS

CN 201504648 U * 6/2010

* cited by examiner

*Primary Examiner* — Adam C Ortiz
(74) *Attorney, Agent, or Firm* — Jose Cherson Weissbrot

(57) ABSTRACT

The present disclosure relates to a bed sheet fastener, comprising a base, a pressing assembly, and a locking part. The base comprises an insertion part and a lateral support part. The pressing assembly is disposed on the lateral support part and includes a connecting part and a locking flange. The locking part comprises a locking hole. The locking part is switchable between an assembled state and a locked state to engage with the pressing assembly to clamp the edge of a bed sheet and achieve stable locking, thereby improving the fastening stability of the bed sheet at the corner of a mattress.

20 Claims, 11 Drawing Sheets

BED SHEET FASTENER

TECHNICAL FIELD

The present disclosure relates to the technical field of furniture auxiliary appliances, and particularly relates to a bed sheet fastener.

BACKGROUND

After existing bed sheets are laid on the surface of a mattress, it is usually necessary to fold the edges of the bed sheet and wrap them around the side edges and the bottom of the mattress to maintain the flatness of the bedding. However, during daily use, due to factors such as human body turning, getting up and lying down, pulling, and the self-resilience of the bed sheet, the bed sheet is particularly prone to loosening, shifting, lifting, or even falling off at the corner of the mattress, which in turn leads to increased wrinkles on the bed surface, affecting comfort and overall tidiness. Users often need to frequently reorganize the bed sheet, resulting in a poor user experience.

To address the above problems, there are some auxiliary structures in the prior art for fastening bed sheets, such as using clips, straps, elastic bands, or simple insert-plate structures to constrain the bed sheet. However, these structures still have certain shortcomings. On one hand, some fastening structures mainly rely on friction or simple clamping to achieve fastening, and their stability after installation is limited, making them prone to loosening when the bed sheet is continuously subjected to force. On the other hand, some structures have poor adaptability to the corners of the mattress and are difficult to simultaneously take into account the limiting and support at two adjacent side edges of the mattress, causing the corner area of the bed sheet to still be prone to local misalignment. In addition, some existing fastening devices are inconvenient to operate during installation or removal, or lack a reliable locking structure, making them prone to accidental detachment during use, thereby affecting the fastening effect of the bed sheet.

SUMMARY

The present disclosure provides a bed sheet fastener to solve the problems raised in the background art.

To achieve the above-mentioned object of the present disclosure, the present disclosure adopts the following technical solutions:

The present disclosure provides a bed sheet fastener for fastening a bed sheet to a mattress corner, including: a base, comprising an insertion part configured to be inserted under the mattress and a lateral support part for abutting against a side edge of the mattress; a pressing assembly disposed on the lateral support part, the pressing assembly comprising a connecting part extending outward from the lateral support part and a locking flange disposed at a distal end of the connecting part, the locking flange protruding outward along a radial direction of the connecting part; and a locking part, comprising a locking hole;

the locking part is configured to be switchable between an assembled state and a locked state relative to the connecting part; in the assembled state, the locking hole is adapted to shapes of the connecting part and the locking flange, allowing the locking part to be fitted onto or removed from the connecting part; in the locked state, the locking part rotates relative to the connecting part, so that the locking hole and the locking flange form a misalignment stop in an axial direction of the connecting part, so as to restrict the locking part from detaching from the connecting part.

The present disclosure further provides a bed sheet fastener for fastening a bed sheet to a mattress corner, including: a base, comprising an insertion part configured to be inserted under the mattress and a lateral support part for abutting against a side edge of the mattress, wherein a side of the insertion part facing the mattress is provided with a plurality of mounting teeth protruding outward from a surface of the insertion part; a pressing assembly disposed on the lateral support part, the pressing assembly comprising a connecting part extending outward from the lateral support part and a locking flange disposed at a distal end of the connecting part, the locking flange protruding outward along a radial direction of the connecting part; and a locking part, comprising a locking hole;

the locking part is configured to be switchable between an assembled state and a locked state relative to the connecting part; in the assembled state, the locking hole is adapted to shapes of the connecting part and the locking flange, allowing the locking part to be fitted onto or removed from the connecting part; in the locked state, the locking part rotates relative to the connecting part, so that the locking hole and the locking flange form a misalignment stop in an axial direction of the connecting part, so as to restrict the locking part from detaching from the connecting part.

The beneficial effects of the present disclosure compared to the prior art are as follows:

The bed sheet fastener of the present disclosure, by inserting the insertion part under the mattress and utilizing the lateral support part to abut against the side edge of the corner of the mattress, can establish a relatively stable support and positioning foundation at the corner of the mattress, particularly by simultaneously providing cooperative support to two adjacent side edges of the mattress, thereby facilitating improved positioning accuracy and fastening stability of the bed sheet corner area, and reducing instances of the bed sheet becoming loose, shifting, lifting, or detaching during use.

On this basis, the pressing assembly and the locking part is engaged with each other, and the locking part is switchable between the assembled state and the locked state relative to the connecting part, so that the locking part may be conveniently installed and removed, and can form a misalignment stop fit with the locking flange through the locking hole in the locked state, thereby effectively restricting the locking part from detaching along the original assembly direction, improving the overall locking reliability, and reducing the possibility of accidental loosening due to external pulling during use. Further, the edge of the bed sheet may be clamped between the locking part and the pressing assembly, with the locking part exerting a pressing force on the outer surface of the bed sheet and the pressing assembly providing a fitting action on the inner surface of the bed sheet, thereby keeping the bed sheet in a relatively stable clamped and fastened state at the corner of the mattress, and further improving the flatness of the bed surface and reducing the frequency of the user repeatedly tidying the bed sheet.

Furthermore, after a plurality of mounting teeth are provided on the side of the insertion part facing the mattress, the friction and limiting capability between the insertion part and the mattress can be further enhanced, wherein the lead-in side of the mounting teeth facilitates reducing insertion resistance and improving installation convenience, while the limiting side of the mounting teeth facilitates improving the anti-detachment capability under reverse force; therefore, the present disclosure is not only simple in structure and convenient to operate, but also balances installation convenience, locking stability, and bed sheet fastening reliability.

BRIEF DESCRIPTION OF DRAWINGS

The drawings, which constitute a part of this application, are used to provide a further understanding of the present disclosure. The schematic embodiments of the present disclosure and the descriptions thereof are used to explain the present disclosure and do not constitute an improper limitation on the present disclosure. In the drawings.

Figure 1:
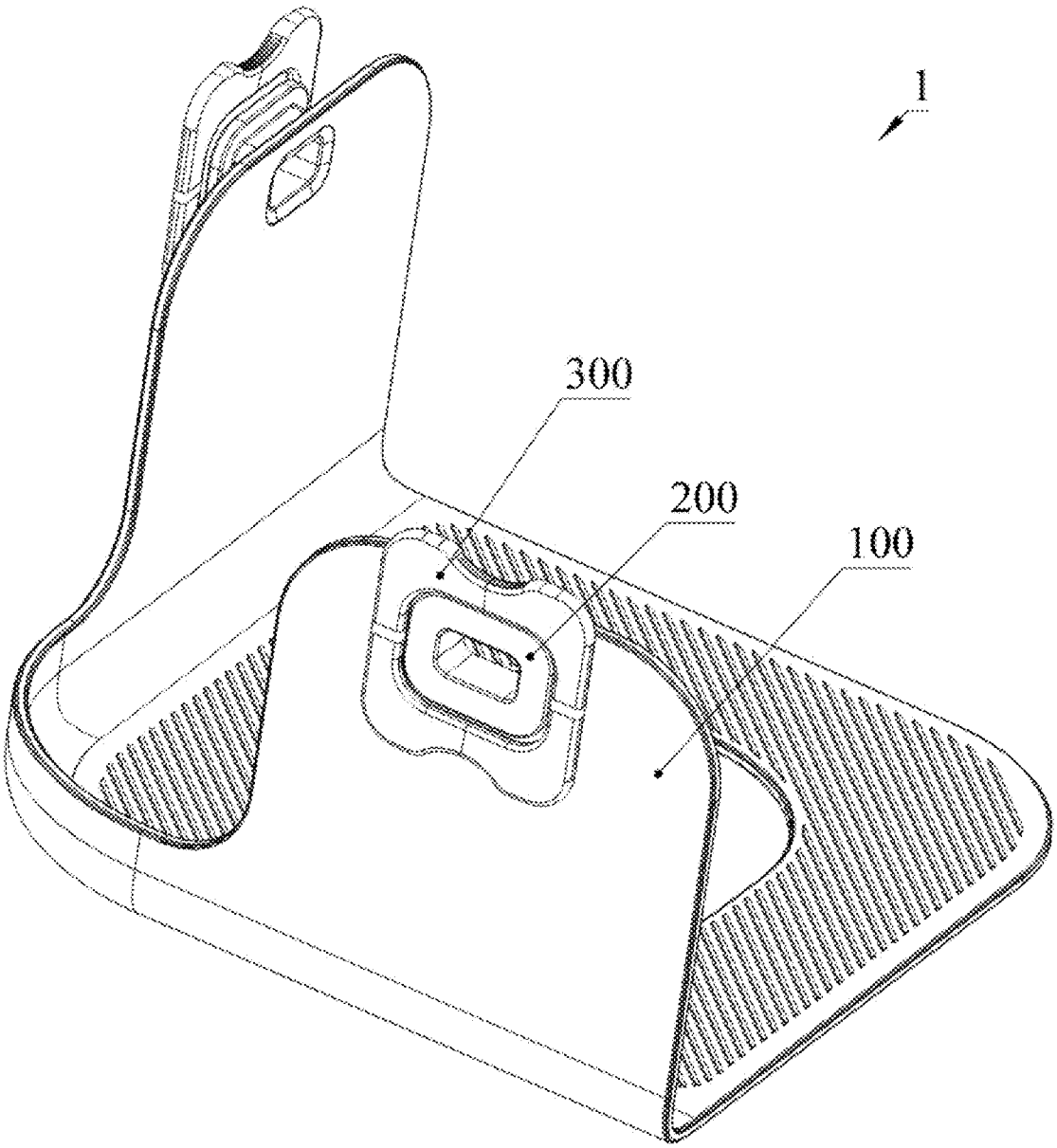
FIG. 1 is a three-dimensional schematic diagram of the embodiment provided by the present disclosure.

Reference signs: Bed Sheet Fastener (1); Base (100); Insertion Part (101); Lateral Support Part (102); Inner Side Surface (103); Outer Side Surface (104); Mounting Tooth (105); Pressing Assembly (200); Locking Flange (201); Protruding Tube (202); First Longitudinal Side (203); First Transverse Side (204); Second Longitudinal Side (205); Second Transverse Side (206); Locking Part (300); Locking Hole (301); Third Longitudinal Side (302); Third Transverse Side (303); Actuating Part (304); Elastic Part (305).

DESCRIPTION OF EMBODIMENTS

The technical solutions in the embodiments of the present disclosure will be clearly and completely described below with reference to the accompanying drawings in the embodiments of the present disclosure. It is apparent that the described embodiments are only a part of the embodiments of the present disclosure, rather than all of them. The following description of at least one exemplary embodiment is illustrative only and is in no way intended to limit the present disclosure and its applications or uses. Based on the embodiments of the present disclosure, all other embodiments obtained by those of ordinary skill in the art without creative efforts shall fall within the scope of protection of the present disclosure.

It should be noted that the terms used herein are only for describing specific embodiments and are not intended to limit the exemplary embodiments according to the present application. As used herein, unless the context clearly indicates otherwise, the singular forms are intended to include the plural forms as well. Furthermore, it should be understood that when the terms "comprise" and/or "include" are used in this specification, they indicate the presence of features, steps, operations, devices, components, and/or combinations thereof.

Unless specifically stated otherwise, the relative arrangement, numerical expressions, and numerical values of components and steps set forth in these embodiments do not limit the scope of the present disclosure. At the same time, it should be understood that for ease of description, the dimensions of the various parts shown in the drawings are not drawn according to actual proportional relationships. Techniques, methods, and equipment known to those of ordinary skill in the relevant art may not be discussed in detail, but where appropriate, such techniques, methods, and equipment should be considered as part of the authorized specification. In all examples shown and discussed herein, any specific values should be construed as illustrative only and not as limiting. Therefore, other examples of the exemplary embodiments may have different values. It should be noted that similar reference numerals and letters denote similar items in the following drawings, so once an item is defined in one drawing, it does not need to be further discussed in subsequent drawings.

Figure 2:
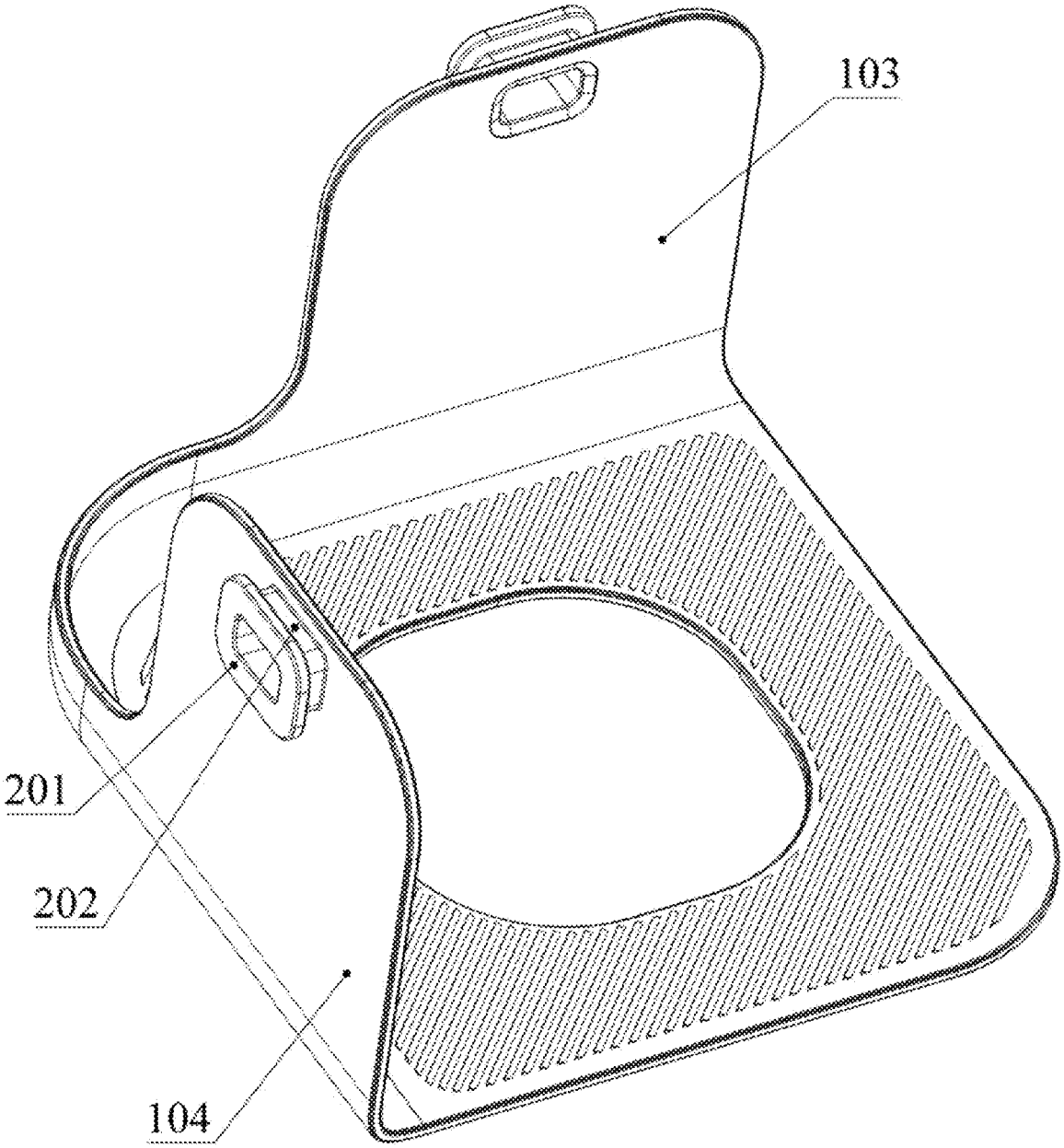
FIG. 2 is a structural schematic diagram of the base of the embodiment in FIG. 1.
Figure 8:
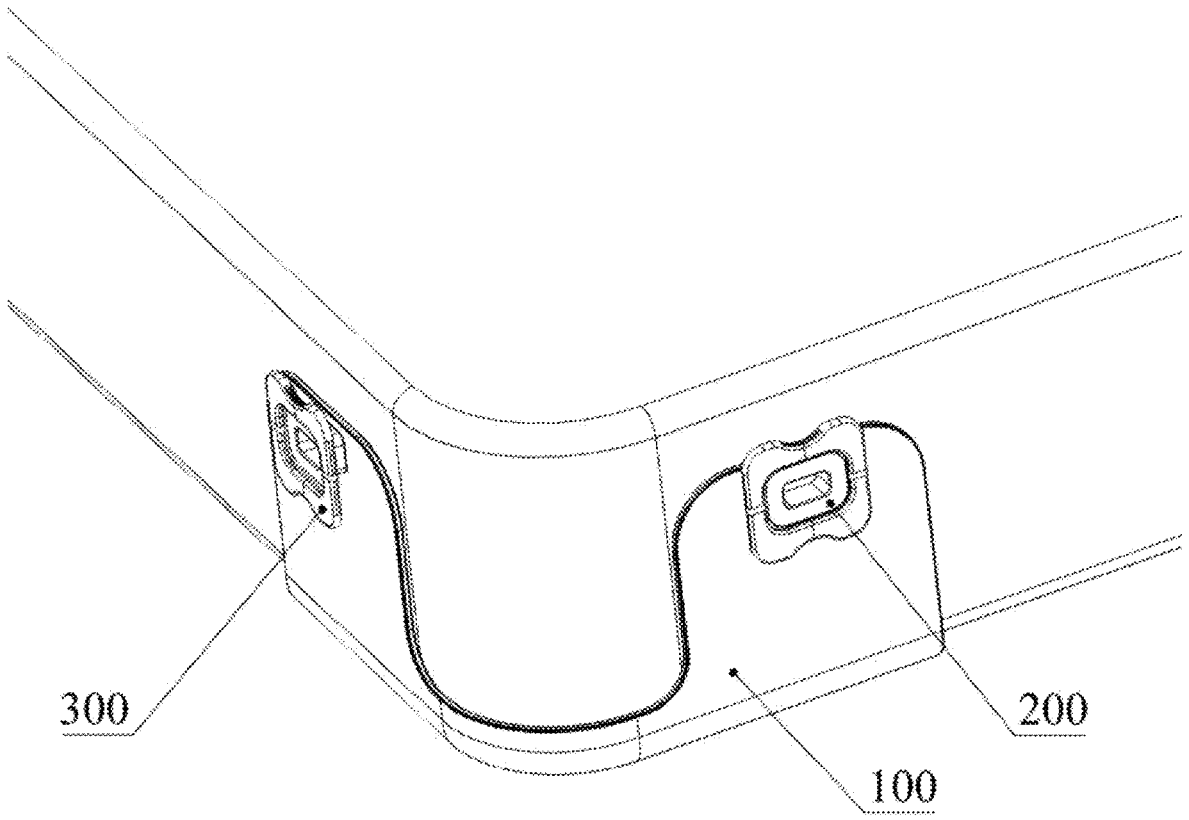
FIG. 8 is an installation schematic diagram of the base of the embodiment shown in FIG. 1 installed at the corner of a mattress.

Referring to FIG. 1, FIG. 2, and FIG. 8, a bed sheet fastener 1 includes a base 100, a pressing assembly 200 disposed on the base 100, and a locking part 300 engaged with the pressing assembly 200. Specifically, the base 100 includes an insertion part 101 and a lateral support part 102 disposed perpendicularly to the insertion part 101. Specifically, the insertion part 101 is used for insertion under the corner of a mattress to provide support for the entire bed sheet fastener 1; the lateral support part 102 is disposed corresponding to the side edge of the corner of the mattress to form lateral support and a positioning base at the corner of the mattress.

Figure 3:
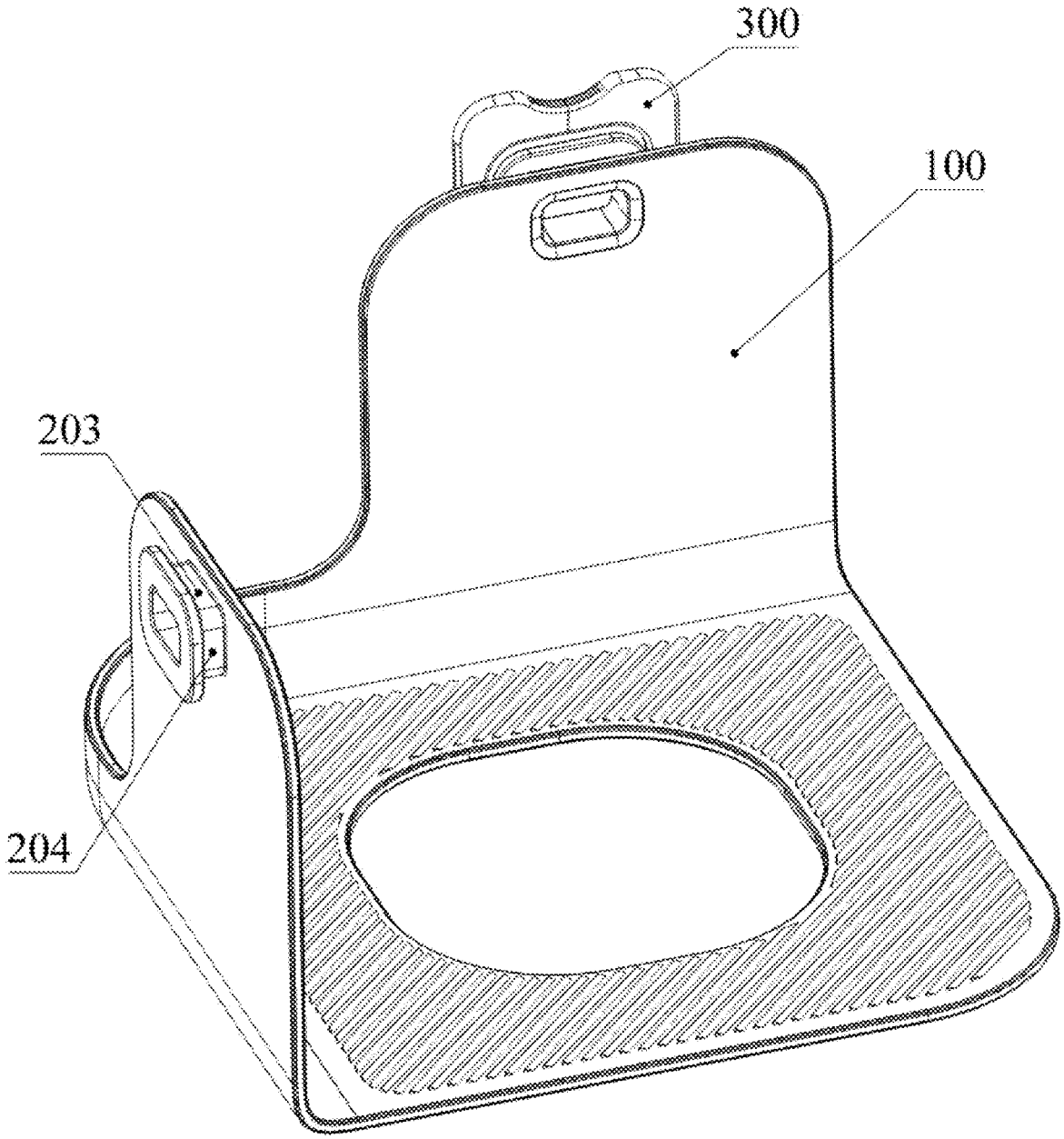
FIG. 3 is a structural schematic diagram of the pressing assembly of the embodiment shown in FIG. 2.

Specifically, referring to FIG. 2 and FIG. 3, in this embodiment, the number of lateral support parts 102 is preferably two, and the two lateral support parts 102 are disposed corresponding to two adjacent side edges of the corner of the mattress, respectively. Both lateral support parts 102 are connected to the insertion part 101 and extend upward from the same side of the insertion part 101, so that a support structure for corner positioning is formed between the two lateral support parts 102 and the insertion part 101. Preferably, the two lateral support parts 102 are disposed at an angle approximately perpendicular to each other, so that the two lateral support parts 102 can enclose to form a corner positioning area adapted to the corner of the mattress.

Further, the lateral support part 102 may be integrally configured as a plate-like structure, including an inner side surface 103 and an outer side surface 104 disposed opposite to each other. The inner side surface 103 is disposed facing the corner positioning area, used for providing support and limiting to the side edge of the corner of the mattress; the outer side surface 104 is disposed facing away from the corner positioning area and may be used for installing the pressing assembly 200 to provide an installation base for the pressing assembly 200.

The pressing assembly 200 is integrally formed on the outer side surface 104. Specifically, the pressing assembly 200 is disposed at a position near the upper end of the lateral support part 102 and protrudes outward from the outer side surface 104 to form an installation portion on the outer side of the lateral support part 102 for the installation and locking of the locking part 300. The pressing assembly 200 is integrally connected with the lateral support part 102, which not only reduces independent components and assembly steps but also helps to improve the connection strength and overall structural stability between the pressing assembly 200 and the lateral support part 102.

Figure 4:
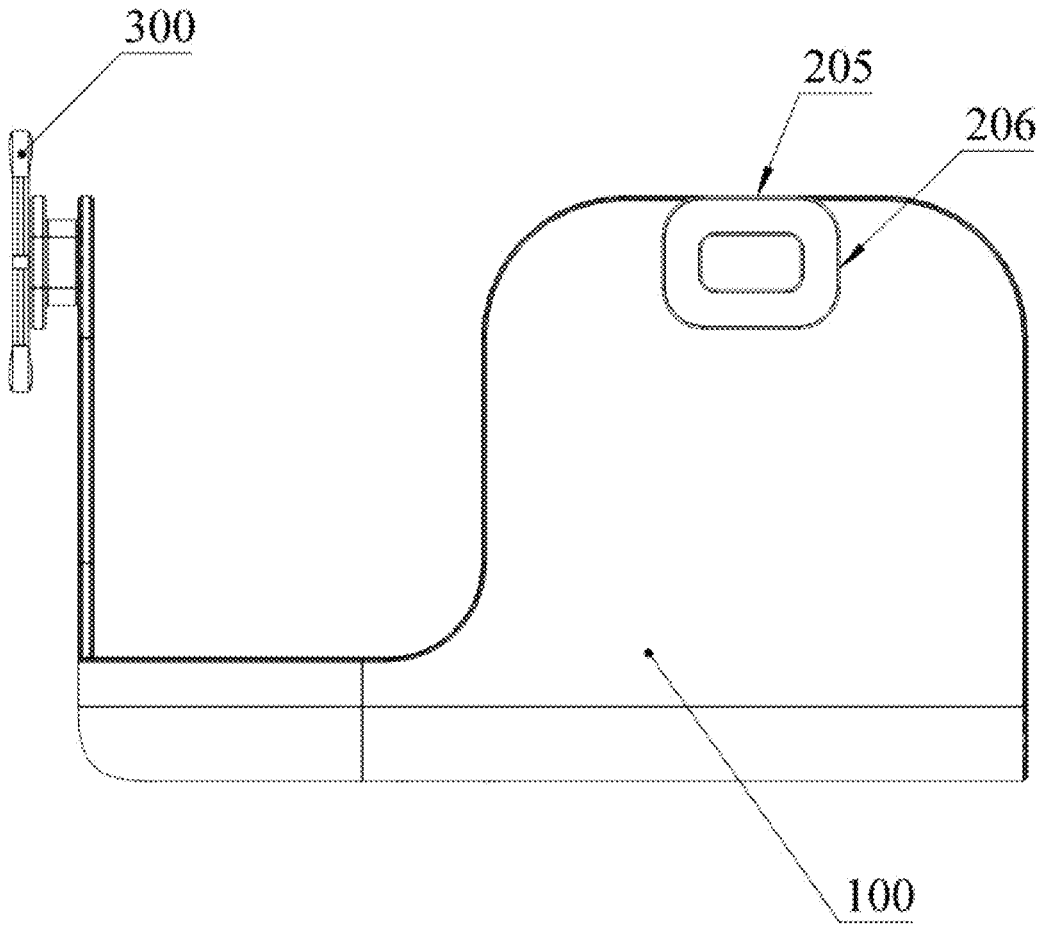
FIG. 4 is a structural schematic diagram of the locking flange of the embodiment shown in FIG. 3.

Referring to FIG. 3 and FIG. 4, in this embodiment, the pressing assembly 200 includes a connecting part and a locking flange 201, wherein the connecting part is preferably a protruding tube 202, and the protruding tube 202 has an overall hollow tubular structure. Specifically, the protruding tube 202 is disposed on the outer side surface 104 and extends outward from the outer side surface 104 to form the main body portion of the pressing assembly 200, and the protruding tube 202 is disposed in a direction parallel to the extending direction of the insertion part 101. Specifically, the protruding tube 202 is preferably a rectangular tubular structure, and its outer periphery includes two oppositely disposed first longitudinal sides 203 and two oppositely disposed first transverse sides 204, wherein the two first longitudinal sides 203 extend along the extending direction of the insertion part 101, and the two first transverse sides 204 are respectively connected between the two first longitudinal sides 203, so that the protruding tube 202 forms an overall rectangular profile with a length direction greater than a width direction. Setting the protruding tube 202 as such a rectangular structure is, on one hand, conducive to forming a mounting structure with a clear orientation on the lateral support part 102, facilitating the assembly of the locking part 300 with the protruding tube 202 in a predetermined direction; on the other hand, compared with a circular structure, the rectangular structure can also provide a more definite limiting relationship during engagement, thereby reducing the possibility of the locking part 300 rotating or shifting relative to the protruding tube 202 and improving the stability of the engagement and connection between the two.

The locking flange 201 is disposed at one end of the protruding tube 202 away from the outer side surface 104 and extends outward along the outer periphery of the protruding tube 202. Specifically, the shape of the locking flange 201 is adapted to the shape of the protruding tube 202 and is preferably a rectangular structure. The outer periphery of the locking flange 201 includes two oppositely disposed second longitudinal sides 205 and two oppositely disposed second transverse sides 206, wherein the two second longitudinal sides 205 respectively extend outward from the outer edges of the two first longitudinal sides 203 of the protruding tube 202 and extend in a direction parallel to the extending direction of the insertion part 101; the two second transverse sides 206 are respectively connected between the two second longitudinal sides 205 and respectively extend outward from the outer edges of the two first transverse sides 204 of the protruding tube 202. Thereby, the locking flange 201 forms a circumferentially outwardly expanding limiting structure at the end of the protruding tube 202. Thus, when the locking part 300 is installed on the protruding tube 202, the locking flange 201 can block and limit the locking part 300, reducing the possibility of the locking part 300 detaching from the outer end of the protruding tube 202, which in turn is conducive to improving the reliability of the connection between the pressing assembly 200 and the locking part 300, and enables the bed sheet to maintain a relatively stable fastened state even when subjected to pulling.

In this embodiment, the locking part 300 is configured to engage with the pressing assembly 200, and the locking part 300 is detachably installed on the protruding tube 202 to form a locking fit with the locking flange 201 after assembly. Specifically, the locking part 300 is provided with a locking hole 301, which is used for the protruding tube 202 to pass through and to form an engagement with the locking flange 201. The shape of the locking hole 301 is adapted to the shapes of the locking flange 201 and the protruding tube 202, and is preferably rectangular. Further, the hole wall of the locking hole 301 includes two third longitudinal sides 302 disposed opposite to each other and two third transverse sides 303 disposed opposite to each other, wherein the two third transverse sides 303 are respectively connected between the two third longitudinal sides 302, so that the locking hole 301 forms a rectangular profile corresponding to the protruding tube 202 and the locking flange 201.

Further, the length of the third transverse side 303 is not greater than the length of the second longitudinal side 205, and is not less than the lengths of the first transverse side 204 and the second transverse side 206; the length of the third longitudinal side 302 is not less than the lengths of the first longitudinal side 203 and the second longitudinal side 205, and is not less than the length of the first longitudinal side 203. Through the above dimensional relationship setting, the locking hole 301 can not only adapt to the protruding tube 202 and the locking flange 201 in a predetermined assembled state to facilitate the installation of the locking part 300 onto the pressing assembly 200, but also form a relatively stable blocking and limiting fit with the locking flange 201 after the locking part 300 is installed in place, thereby reducing the possibility of the locking part 300 detaching from the outer end of the protruding tube 202, improving the reliability of the connection between the pressing assembly 200 and the locking part 300, and helping to maintain the stability of the bed sheet in a fastened state.

Figure 5:
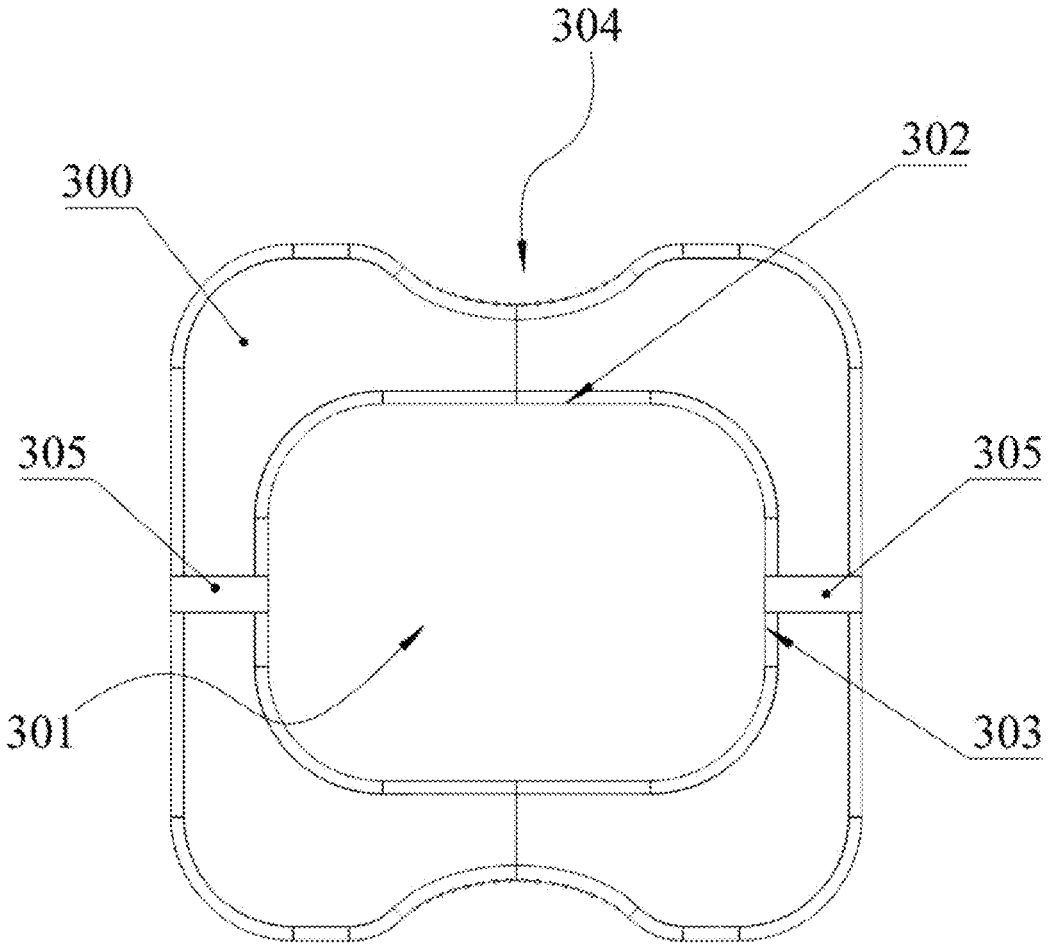
FIG. 5 is a structural schematic diagram of the locking part of the embodiment shown in FIG. 1.
Figure 11:
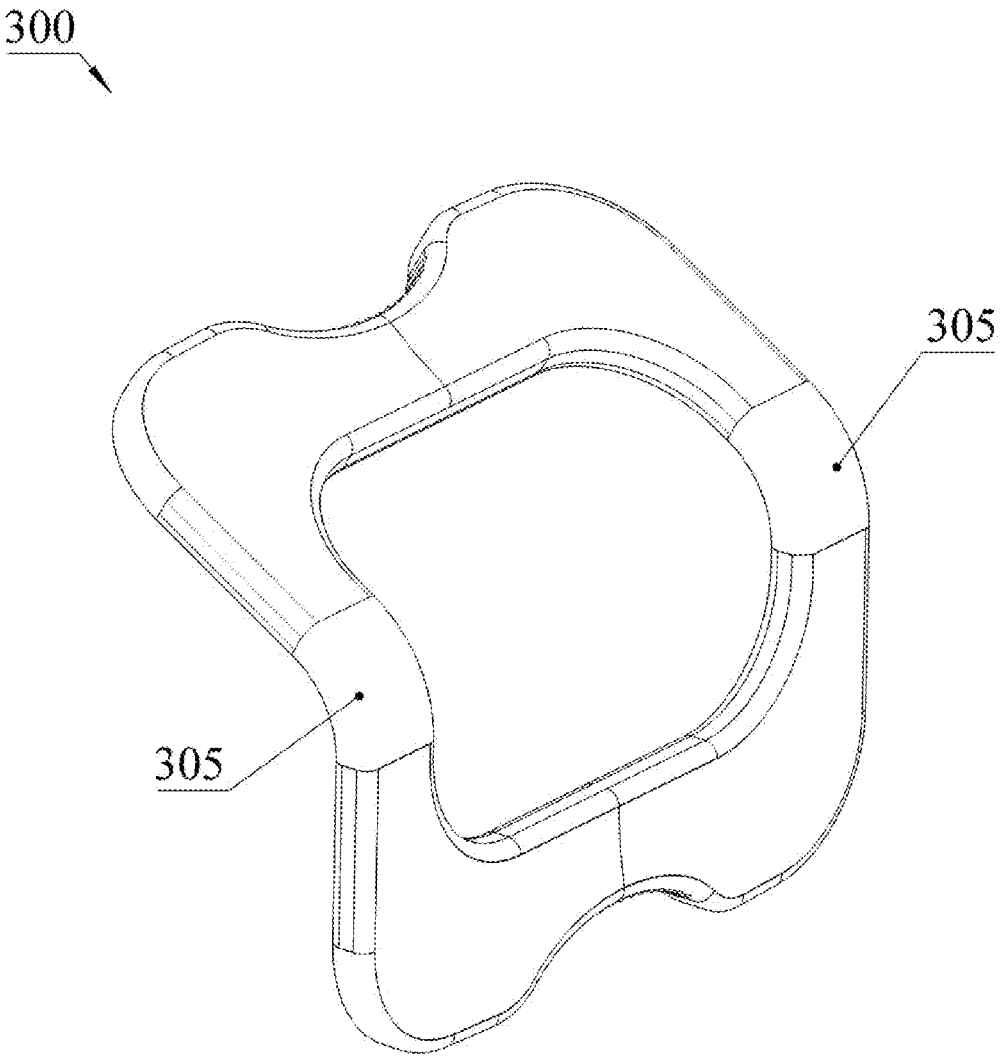
FIG. 11 is a schematic diagram of the bent state of the elastic part of the embodiment shown in FIG. 5.

Specifically, referring to FIGS. 5 and 11, in this embodiment, to facilitate the installation of the locking part 300, it further includes an actuating part 304 recessed on the locking part 300. The actuating part 304 is located in the peripheral area of the locking hole 301 to form an operating portion for the user's finger to apply force, thereby facilitating the rotation of the locking part 300 relative to the pressing assembly 200. Wherein, the locking part 300 further includes an elastic part 305 disposed opposite on the locking part 300. The elastic part 305 has a certain toughness and can stretch and bend during the process of being installed onto the protruding tube 202 and the locking flange 201 to adapt to deformation requirements during assembly, thereby reducing the assembly resistance between the locking part 300 and the protruding tube 202 and the locking flange 201, and facilitating the smooth installation of the locking part 300 into place. Furthermore, during the process of the locking part 300 rotating relative to the protruding tube 202 to achieve locking or unlocking, the elastic material can also provide a certain degree of clearance, which is conducive to reducing rotational interference and improving the smoothness of the operation process of the locking part 300. Further, the elastic part 305 can also provide a cushioning effect when the user touches the locking part 300, preventing the user from directly touching hard edges and causing injury, thereby improving usage safety and grip comfort.

In other embodiments of the present disclosure (not shown), to improve the convenience of the user's actuating operation, the actuating part 304 may also be replaced by a toggle structure protruding outward from the surface of the locking part 300, an anti-slip rib structure provided on the surface of the locking part 300, or a pull-hole structure penetrating the locking part 300. Specifically, the actuating part 304 may be provided on one or both sides of the locking hole 301 and extend in a direction convenient for the user's finger to apply force, allowing the user to drive the locking part 300 to rotate relative to the protruding tube 202 by pressing, toggling, or pulling. Through the above settings, different operating structures may be selected according to the overall size of the bed sheet fastener 1 and actual usage habits, thereby helping to improve human-machine operability during the installation and unlocking processes.

Figure 6:
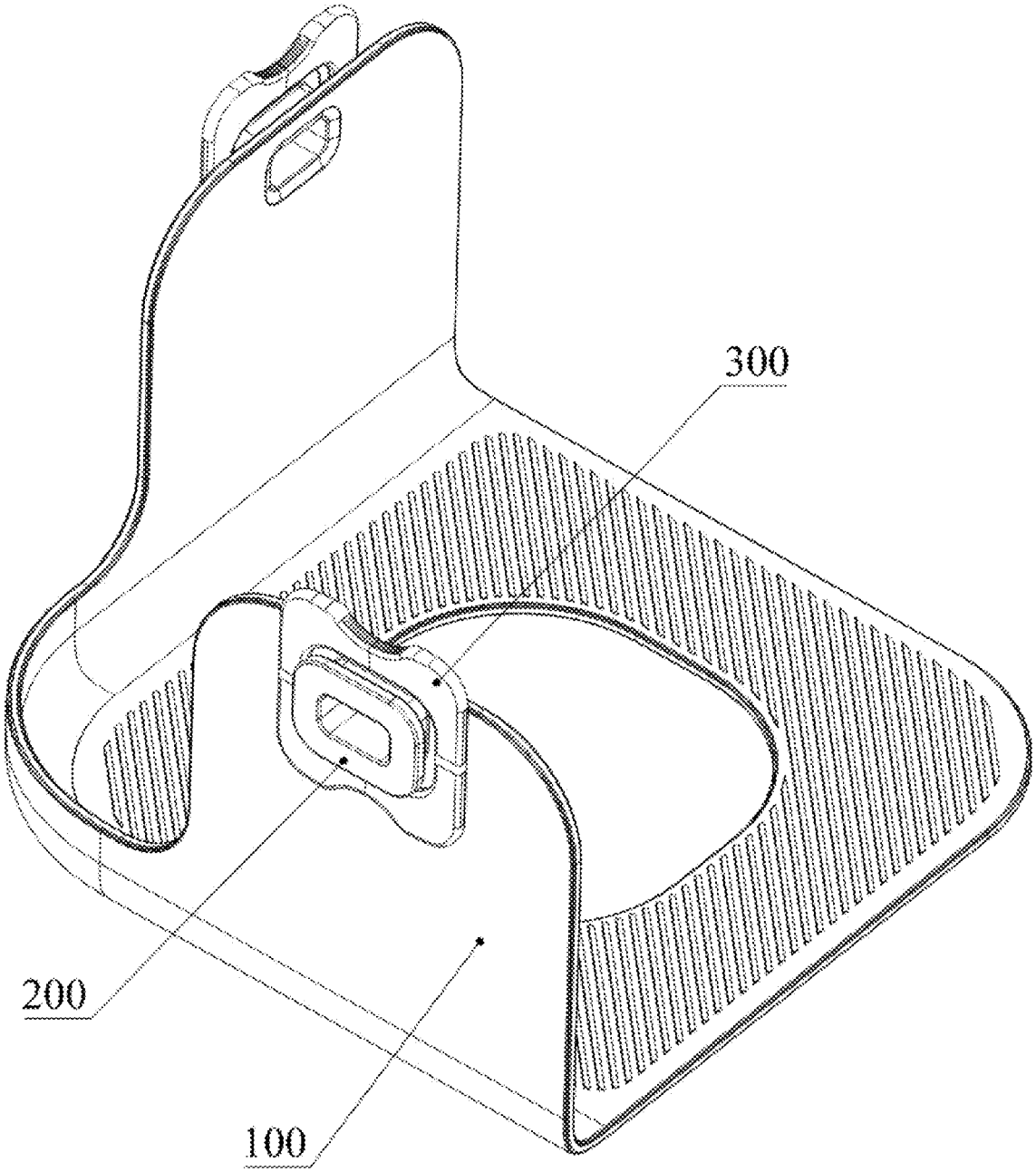
FIG. 6 is an installation schematic diagram of the locking part of the embodiment shown in FIG. 1.
Figure 7:
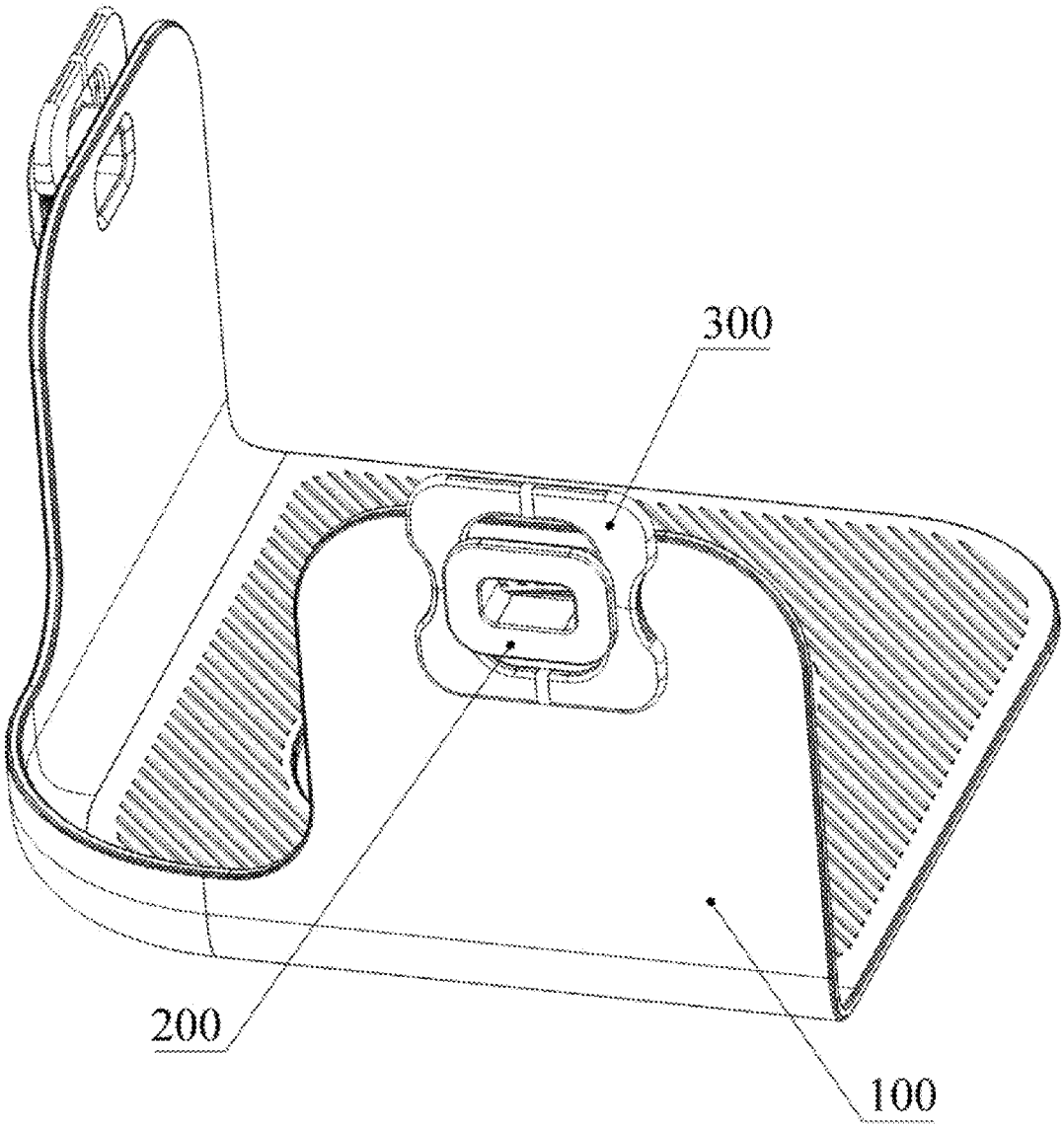
FIG. 7 is a schematic diagram of the locked state of the locking part of the embodiment shown in FIG. 6.

As shown in FIG. 1, FIG. 6, and FIG. 7, during installation, first adjust the locking part 300 to the assembled state so that the locking hole 301 is aligned with the protruding tube 202 and the locking flange 201. At this time, the two third longitudinal sides 302 of the locking hole 301 correspond to the two first longitudinal sides 203 of the protruding tube 202 and the two second longitudinal sides 205 of the locking flange 201, respectively, and the two third transverse sides 303 of the locking hole 301 correspond to the two first transverse sides 204 of the protruding tube 202 and the two second transverse sides 206 of the locking flange 201, respectively. Since the length of the third longitudinal side 302 is not less than the lengths of the first longitudinal side 203 and the second longitudinal side 205, and the length of the third transverse side 303 is not less than the lengths of the first transverse side 204 and the second transverse side 206, the locking hole 301 has a clearance space for the protruding tube 202 and the locking flange 201 to pass through in this aligned state. Based on this, when the locking part 300 is pushed toward the pressing assembly 200, the protruding tube 202 can smoothly pass into the locking hole 301, and the locking flange 201 can also pass through the locking hole 301, thereby allowing the locking part 300 to be installed in place and sleeved onto the protruding tube 202.

Before installing the locking part 300, the edge of the bed sheet may be guided to an area where the pressing assembly 200 is engaged with the locking part 300, so that the bed sheet is located on the outer side of the lateral support part 102. As the locking part 300 is pushed toward the pressing assembly 200 and installed in place, the edge of the bed sheet may be clamped between the locking part 300 and the pressing assembly 200, wherein the locking part 300 is used to abut against the outer surface of the bed sheet, and the pressing assembly 200 is used to abut against the inner surface of the bed sheet, thereby forming a clamped and fastened state for the bed sheet at the corner of the mattress. Through the above configuration, while the locking part 300 and the pressing assembly 200 form a locking fit, they can also jointly exert a clamping effect on the edge of the bed sheet to reduce the possibility of the bed sheet coming loose from the corner of the mattress.

In other embodiments of the present disclosure (not shown), in order to improve the clamping stability of the pressing assembly 200 and the locking part 300 on the edge of the bed sheet, the side of at least one of the pressing assembly 200 and the locking part 300 facing the bed sheet may be replaced with a pressing surface structure with anti-slip texture. Specifically, the side of the pressing assembly 200 facing the inner surface of the bed sheet may be provided with striped protrusions, dot-shaped protrusions, soft friction pads, or an elastic coating layer, and the side of the locking part 300 facing the outer surface of the bed sheet may also be provided with a corresponding anti-slip contact surface, so that the edge of the bed sheet forms greater contact friction after being clamped. Through the above configuration, the anti-slip ability of the bed sheet edge can be improved without excessively increasing the clamping force, thereby facilitating the maintenance of a flat state of the bed sheet after being fastened.

When the locking part 300 is installed in place, the user may actuate the actuating part 304 to drive the locking part 300 to rotate relative to the protruding tube 202, causing the locking hole 301 to change from the aforementioned aligned state to a misaligned state relative to the locking flange 201. After rotation, the third transverse side 303 of the locking hole 301, which originally corresponded to the second transverse side 206 of the locking flange 201, instead forms a limiting fit with the second longitudinal side 205 of the locking flange 201. Since the length of the third transverse side 303 is not greater than the length of the second longitudinal side 205, when the locking part 300 moves in the disassembly direction, the second longitudinal side 205 of the locking flange 201 can block the third transverse side 303 of the locking hole 301, preventing the locking part 300 from directly detaching from the protruding tube 202 along the original assembly direction, thereby achieving locking. Meanwhile, since the length of the third transverse side 303 is not less than the first transverse side 204, and the length of the third longitudinal side 302 is not less than the first longitudinal side 203, the locking part 300 can remain sleeved outside the protruding tube 202 in the rotated locked state without interfering with the protruding tube 202 due to rotation, thereby ensuring a smooth locking process and a stable locked state. At this time, the edge of the bed sheet clamped between the locking part 300 and the pressing assembly 200 is also stably limited, and the stability of the bed sheet after being fastened is further improved under the pressing action of the locking part 300 on the outer surface of the bed sheet and the supporting action of the pressing assembly 200 on the inner surface of the bed sheet.

When unlocking is required, continue to actuate the actuating part 304 to rotate the locking part 300 until the locking hole 301 is realigned with the protruding tube 202 and the locking flange 201. At this time, the blocking action of the locking flange 201 on the locking hole 301 is released, and the locking part 300 may be removed from the protruding tube 202 in a direction away from the outer side surface 104, thereby achieving unlocking. Through the above structural configuration, the locking part 300 may be smoothly installed on the pressing assembly 200 and stably locked after rotation, which is conducive to improving the locking reliability and operational stability of the bed sheet fastener 1.

Figure 9:
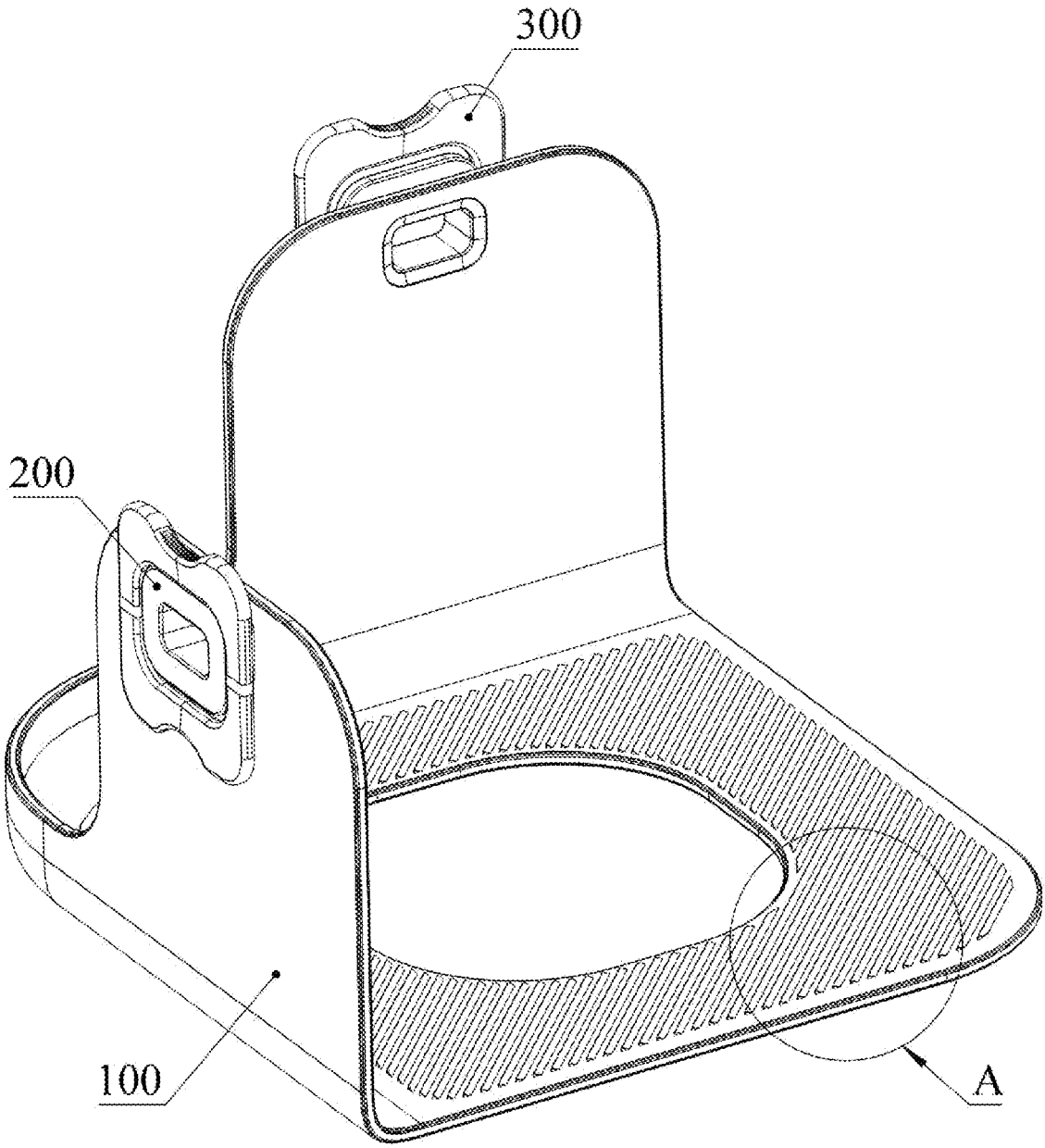
FIG. 9 is another three-dimensional schematic diagram of the embodiment shown in FIG. 1.
Figure 10:
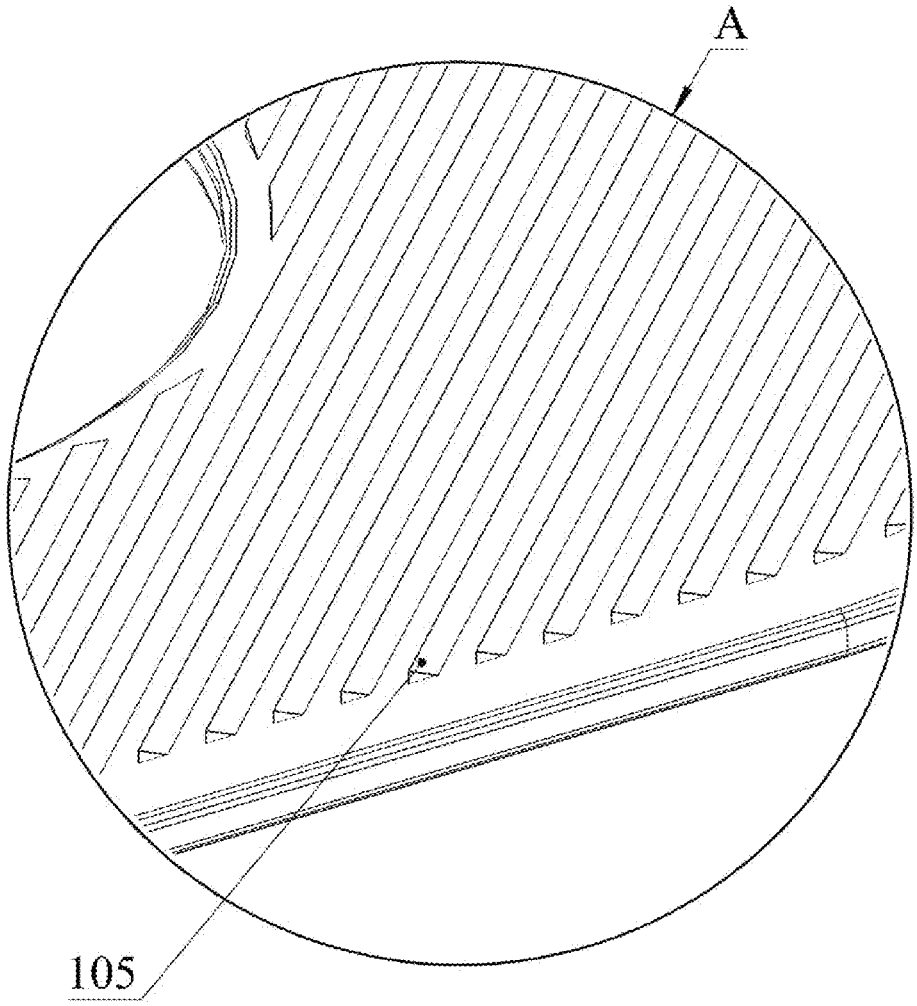
FIG. 10 is a partial schematic diagram of section A of the embodiment shown in FIG. 9.

Further, referring to FIG. 9 and FIG. 10, in this embodiment, the side of the insertion part 101 that contacts the mattress is integrally formed with a plurality of mounting teeth 105, which are configured to protrude outward from the surface of the insertion part 101. Specifically, the mounting teeth 105 are preferably strip-shaped or sawtooth-shaped, and their longitudinal direction may extend along the transverse direction of the insertion part 101, so that after the insertion part 101 is inserted under the mattress, it forms an interlocking or frictional fit with the mattress at multiple positions, thereby increasing the contact friction between the insertion part 101 and the mattress and improving the stability of the insertion part 101 after installation.

Further, the mounting tooth 105 has an introduction side facing the insertion direction of the insertion part 101 and a limiting side facing away from the insertion direction, wherein the introduction side is preferably an inclined surface structure, and the limiting side is preferably a relatively steep stop surface structure. Thus, when the insertion part 101 is inserted under the mattress, the mounting tooth 105 can provide a relatively gentle guiding effect on the mattress through the introduction side, thereby reducing insertion resistance and facilitating the smooth installation of the insertion part 101 into place; when the insertion part 101 is subjected to a reverse pulling force, the limiting side of the mounting tooth 105 can increase the blocking and frictional effects with the mattress, thereby improving the anti-withdrawal capability of the insertion part 101 and reducing the possibility of the bed sheet fastener 1 accidentally loosening or falling off due to external pulling during use. Through the above configuration, the mounting tooth 105 not only facilitates the installation of the bed sheet fastener 1 but also further enhances the connection stability between it and the mattress after installation.

In the description of the present disclosure, it should be understood that directional terms such as "front, back, upper, lower, left, right," "transverse, vertical, perpendicular, horizontal," and "top, bottom," generally refer to the orientations or positional relationships shown in the accompanying drawings. They are used only for the convenience of describing the present disclosure and simplifying the description. Unless otherwise specified, these directional terms do not indicate or imply that the device or element referred to must have a specific orientation or be constructed and operated in a specific orientation, and therefore should not be construed as limiting the scope of protection of the present disclosure. The directional terms "inner, outer" refer to the inside and outside relative to the profile of each component itself.

For ease of description, spatial relative terms such as "on," "above," "upper surface," "upper," may be used herein to describe the spatial relationship of one device or feature to other devices or features as illustrated in the figures. It should be understood that the spatial relative terms are intended to encompass different orientations of the device in use or operation in addition to the orientation depicted in the figures. For example, if a device in the FIGS. is inverted, a device described as being "above" or "on" other devices or structures would then be oriented as "below" or "beneath" the other devices or structures. Thus, the exemplary term "above" can encompass both "above" and "below" orientations. The device may also be oriented in other ways (rotated 90 degrees or at other orientations), and the spatial relative descriptions used herein should be interpreted accordingly.

Furthermore, it should be noted that the use of terms such as "first", "second" to define components is merely for the purpose of distinguishing the corresponding components, and unless otherwise stated, these terms do not have special meanings. Therefore, they should not be construed as limiting the scope of protection of the present disclosure.

The above descriptions are merely preferred embodiments of the present disclosure and are not intended to limit the present disclosure. For those skilled in the art, various modifications and changes can be made to the present disclosure. Any modification, equivalent substitution and improvement made within the spirit and principles of the present disclosure shall be included within the scope of protection of the present disclosure.

What is claimed is:

1. Abed sheet fastener for fastening a bed sheet to a corner of a mattress, comprising:

a base, comprising an insertion part configured to be inserted under the mattress and a lateral support part for abutting against a side edge of the mattress;

a pressing assembly disposed on the lateral support part, the pressing assembly comprising a connecting part extending outward from the lateral support part and a locking flange disposed at a distal end of the connecting part, the locking flange protruding outward along a radial direction of the connecting part; and a locking part, comprising a locking hole;

wherein the locking part is configured to be switchable between an assembled state and a locked state relative to the connecting part;

wherein in the assembled state, the locking hole is adapted to shapes of the connecting part and the locking flange, allowing the locking part to be fitted onto or removed from the connecting part; and wherein in the locked state, the locking part rotates relative to the connecting part, so that the locking hole and the locking flange form a misalignment stop in an axial direction of the connecting part, so as to restrict the locking part from detaching from the connecting part.

2. The bed sheet fastener according to claim 1, wherein there are two lateral support parts, the two lateral support parts are respectively disposed corresponding to two adjacent side edges of the corner of the mattress, and both the lateral support parts are connected to the insertion part and extend upward from a same side of the insertion part.

3. The bed sheet fastener according to claim 2, wherein the two lateral support parts are disposed at an approximately perpendicular angle to each other.

4. The bed sheet fastener according to claim 1, wherein the lateral support part comprises an inner side surface and an outer side surface disposed opposite to each other, the inner side surface is disposed facing the corner of the mattress, and the outer side surface is disposed facing away from the corner of the mattress.

5. The bed sheet fastener according to claim 4, wherein the pressing assembly is disposed at a position near an upper end of the lateral support part and protrudes outward from the outer side surface.

6. The bed sheet fastener according to claim 5, wherein the pressing assembly is integrally formed with the lateral support part.

7. The bed sheet fastener according to claim 5, wherein the connecting part is a protruding tube disposed on the outer side surface in a direction parallel to an extending direction of the insertion part.

8. The bed sheet fastener according to claim 7, wherein the locking part is detachably mounted on the protruding tube, the locking hole is provided on the locking part, and the locking hole is configured for the protruding tube to pass through and engage with the locking flange.

9. The bed sheet fastener according to claim 1, wherein the locking part comprises elastic parts disposed opposite to each other on the locking part.

10. The bed sheet fastener according to claim 1, wherein an actuating part is recessed into the locking part.

11. Abed sheet fastener for fastening a bed sheet to a corner of a mattress, comprising:

a base, comprising an insertion part configured to be inserted under the mattress and a lateral support part for abutting against a side edge of the mattress, wherein a side of the insertion part facing the mattress is provided with a plurality of mounting teeth protruding outward from a surface of the insertion part;

a pressing assembly disposed on the lateral support part, the pressing assembly comprising a connecting part extending outward from the lateral support part and a locking flange disposed at a distal end of the connecting part, the locking flange protruding outward along a radial direction of the connecting part; and a locking part, comprising a locking hole;

wherein the locking part is configured to be switchable between an assembled state and a locked state relative to the connecting part;

wherein in the assembled state, the locking hole is adapted to shapes of the connecting part and the locking flange, allowing the locking part to be fitted onto or removed from the connecting part; and wherein in the locked state, the locking part rotates relative to the connecting part, so that the locking hole and the locking flange form a misalignment stop in an axial direction of the connecting part, so as to restrict the locking part from detaching from the connecting part.

12. The bed sheet fastener according to claim 11, wherein there are two lateral support parts, the two lateral support parts are respectively disposed corresponding to two adjacent side edges of the corner of the mattress, and both the lateral support parts are connected to the insertion part and extend upward from a same side of the insertion part.

13. The bed sheet fastener according to claim 12, wherein the two lateral support parts are disposed at an approximately perpendicular angle to each other.

14. The bed sheet fastener according to claim 11, wherein the lateral support part comprises an inner side surface and an outer side surface disposed opposite to each other, the inner side surface is disposed facing the corner of the mattress, and the outer side surface is disposed facing away from the corner of the mattress.

15. The bed sheet fastener according to claim 14, wherein the connecting part is a protruding tube disposed on the outer side surface in a direction parallel to an extending direction of the insertion part.

16. The bed sheet fastener according to claim 15, wherein the protruding tube is a rectangular tubular structure, and an outer periphery of the protruding tube comprises two first longitudinal sides disposed opposite to each other and two first transverse sides disposed opposite to each other.

17. The bed sheet fastener according to claim 16, wherein the locking flange is provided at an end of the protruding tube away from the outer side surface and extends outward along the outer periphery of the protruding tube, the locking flange is of a rectangular structure, and an outer periphery of the locking flange comprises two second longitudinal sides disposed opposite to each other and two second transverse sides disposed opposite to each other.

18. The bed sheet fastener according to claim 17, wherein the locking hole of the locking part is rectangular, and a hole wall of the locking hole comprises two third longitudinal sides disposed opposite to each other and two third transverse sides disposed opposite to each other, the two third transverse sides being respectively connected between the two third longitudinal sides.

19. The bed sheet fastener according to claim 18, wherein a length of the third transverse side is not greater that of the second longitudinal side and is not less than those of the first transverse side and the second transverse side, and a length of the third longitudinal side is not less than those of the first longitudinal side and the second longitudinal side and is not less than that of the first longitudinal side.

20. The bed sheet fastener according to claim 11, wherein the locking part comprises elastic parts disposed opposite to each other on the locking part.

* * * * *